United States Patent [19]

Reznik

[11] Patent Number: 5,050,315

[45] Date of Patent: Sep. 24, 1991

[54] APPARATUS FOR SOLVENT RECOVERY FROM INDUCTION HEATED COATED DRUMS

[76] Inventor: David Reznik, 2151 Barbara Dr., Palo Alto, Calif. 94303

[21] Appl. No.: 297,428

[22] Filed: Jan. 17, 1989

[51] Int. Cl.[5] ..... F26B 19/00

[52] U.S. Cl. ..... 34/60; 34/106

[58] Field of Search ..... 34/60, 104, 105, 106; 118/58, 69, 642, 643; 427/231, 374.1

[56] References Cited

U.S. PATENT DOCUMENTS 2,355,459 8/1944 Miskella ..... 34/105

4,133,910 1/1979 Ruwe et al. ..... 427/231 X 4,421,781 12/1983 Reznik .

4,680,871 7/1987 Reznik .

4,694,586 9/1987 Reznik .

*Primary Examiner*—Henry A. Bennet

*Assistant Examiner*—John Sollecito

*Attorney, Agent, or Firm*—Cushman, Darby & Cushman

[57] ABSTRACT

Apparatus for drying or curing a coating on a metal substrate comprising an induction coil arranged in a generally cylindrical configuration, a cooling coil arranged in a cylindrical configuration, generally cocylindrical with and spaced from the induction coil, thereby defining a receiving volume therebetween for removably receiving a generally cylindrical coated metal substrate, a top member sealing the top of said receiving volume and apparatus for selectably inserting and removing a coated metal substrate from the receiving volume.

10 Claims, 3 Drawing Sheets

APPARATUS FOR SOLVENT RECOVERY FROM INDUCTION HEATED COATED DRUMS

FIELD OF THE INVENTION

The present invention relates to apparatus and methods for drying and curing coated substrates and more particularly to drying and curing of organically coated drum cylinders.

BACKGROUND OF THE INVENTION

Conventionally, organic coated substrates are cured in hot air ovens in which the substrate is exposed to temperatures in the range of 150–210 degrees Centigrade for a dwell time of about 10–20 minutes. This conventional curing technique involves the disadvantage that the carrier solvent of the coating is evaporated and produces harmfull air pollution if released to the atmosphere. Also, efficiency considerations, due to the relatively long baking time required, generally dictate the use of very large and cumbersome ovens.

In practice, most of the hot air containing the solvent vapors is normally recirculated for energy conservation considerations and as a result, the solvent vapors must be incinerated, at a significant cost in energy.

Water based coatings have been developed in an effort to reduce the air pollution resulting from curing. These coatings also include a small proportion of organic solvents and are only suitable for a limited range of applications.

In U.S. Pat. Nos. 4,680,871 and 4,694,586 of the present applicant there are described and claimed apparatus and techniques for drying or curing a coating on a metal substrate such as a drum wall cylinder. In FIG. 2 of both patents and in the accompanying discussion in the specification there is shown apparatus for curing a coating on a metal substrate including apparatus for inductively heating the coated substrate in a confined space and apparatus for condensing evaporated liquids.

SUMMARY OF THE INVENTION

The present invention seeks to provide improved apparatus and techniques for drying or curing a coating on a metal substrate, such as a drum wall cylinder.

There is thus provided in accordance with a preferred embodiment of the present invention apparatus for drying or curing a coating on a metal substrate comprising an induction coil arranged in a generally cylindral configuration, a cooling coil arranged in a cylindrical configuration, generally cocylindrical with and spaced from the induction coil, thereby defining a receiving volume therebetween for removably receiving a generally cylindrical coated metal substrate, a top member sealing the top of said receiving volume and apparatus for selectably inserting and removing a coated metal substrate from the receiving volume.

In accordance with a preferred embodiment of the invention, a container is located interiorly of the receiving volume, generally filling the volume interior of the receiving volume.

Further in accordance with a preferred embodiment of the invention, a pair of drum rings is provided, the first drum ring being located adjacent the top edge of the drum, and the second drum ring being located adjacent the bottom edge of the drum. The drum rings are operative to prevent non-uniform heating of the edges of the drum.

Further in accordance with a preferred embodiment of the invention, there is provided in operative association with the cooling coil, apparatus for receiving solvent condensate. Additionally in accordance with an embodiment of the invention, there is provided apparatus for removing solvent condensate from the receiving apparatus.

Additionally in accordance with a preferred embodiment of the invention, the apparatus for inserting and removing comprises means for sealing the bottom of the receiving volume when the substrate is located in the receiving volume, enabling the drying or curing apparatus to operate in vacuum.

Further in accordance with an embodiment of the invention, the apparatus for inserting and removing comprises means for rotating the substrate.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
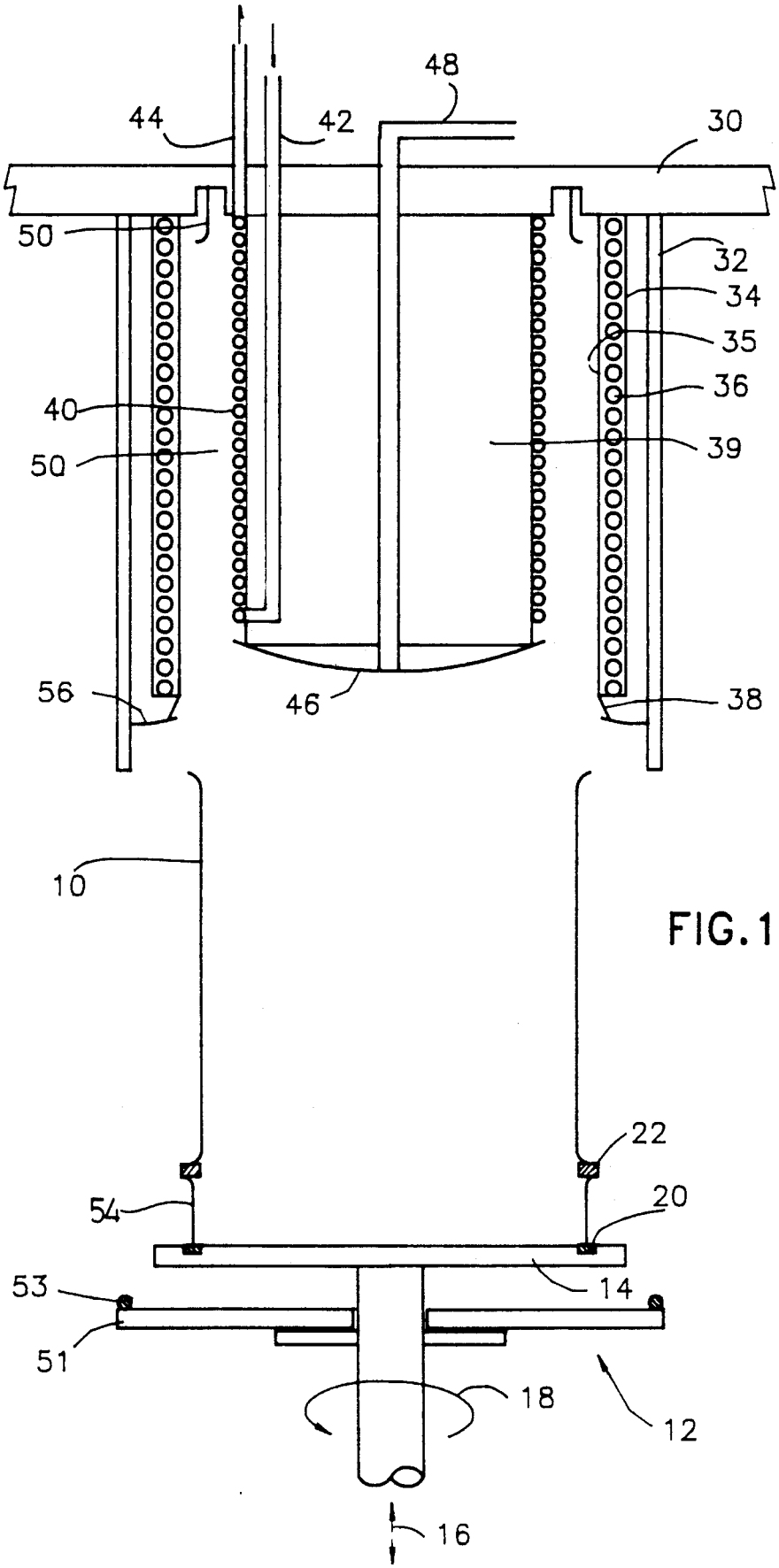
FIG. 1 is a side sectional illustration of apparatus for heating or curing a coating on a metal substrate in accordance with a preferred embodiment of the present invention in a first operative orientation.
Figure 2:
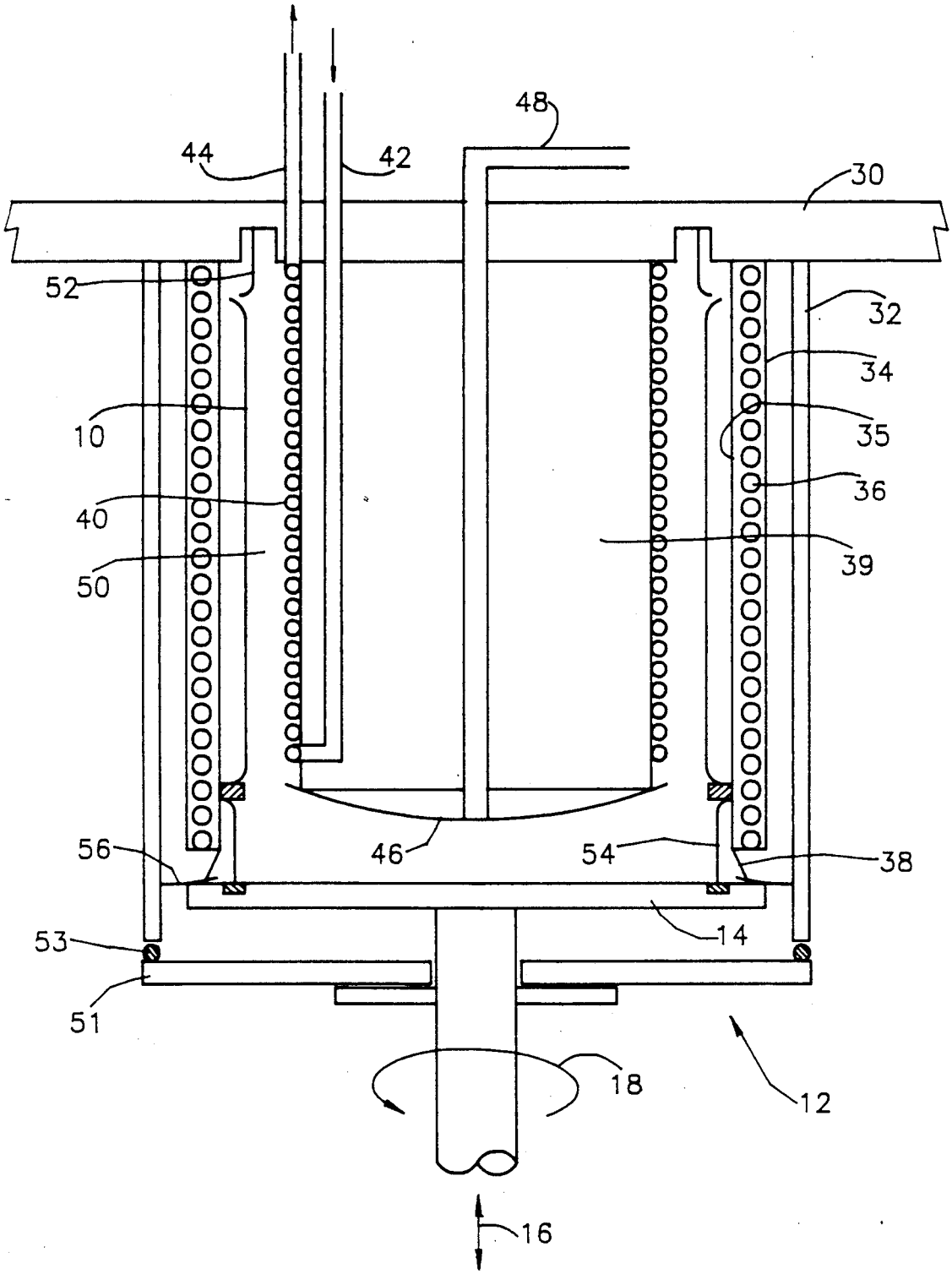
FIG. 2 is a side sectional illustration of the apparatus of FIG. 1 in a second operative orientation.

Reference is now made to FIGS. 1 and 2, which illustrate the apparatus of the present invention in first and second operative orientations, with the substrate respectively removed from and inserted within the receiving volume. The general technique of heating or curing substrates in accordance with the present invention is described in U.S. Pat. Nos. 4,680,871, 4,694,586 and 4,421,781 of the present applicant, the disclosures of which are hereby incorporated by reference.

Following the lacquer coating step, a barrel wall portion 10 is located on a support assembly 12, typically formed of aluminum. The support assembly 12 comprises a base 14, which is arranged to be selectably raised and lowered by suitable lifting apparatus (not shown) as indicated by arrows 16 and to be rotated by suitable rotation apparatus (not shown) as indicated by arrow 18. This rotation enhances the uniformity of energy distribution. Arranged on base 14 is a steel ring 54, which includes insulating and aligning means 22 for aligning barrel wall portion 10 with respect to ring 54. Ring 54 is aligned with respect to base 14 by means of base aligning means 20, such as an insulated groove.

Aligning means 20 and 22 are typically formed of a ceramic material with the addition of supporting beads with insulating properties which are operative to prevent heat sink.

The support assembly 12 is arranged to selectably locate the substrate barrel wall portion 10 in operative association with a curing unit, as illustrated in FIG. 2.

The curing unit preferably comprises a sealing top portion 30, which may be fixed. Arranged in a generally vertical depending relationship and sealed with respect to top portion 30 is an outer cylinder 32, typically formed of aluminum. Disposed interiorly of outer cylinder 32 are a pair of induction coil support cylinders 34 and 35, typically formed of fiberglass, and which support therebetween an induction coil 36, which is coupled to a source of electrical power (not shown). Disposed interiorly of induction coil 36 are a plurality of guide rods 38, typically formed of a ceramic material.

Arranged generally cocylindrically with induction coil 36 and cylinders 34 and 35 and interiorly spaced therefrom is a cylindrical container 39 which may be filled with a cooled liquid. On the outer surface of container 39 there is provided a generally cylindrically arranged cooling coil 40, which is coupled to a cooling fluid inlet 42 and outlet 44.

Induction coils 36 typically run substantially parallel to the longitudinal axis of outer cylinder 32 and extend slightly beyond the top and the bottom of cylinder 10.

Preferably, a first condensate collector 46 is disposed adjacent the bottom of container 39 and underlying coil 40, for collection of condensed solvent, as shown in FIG. 1. The condensed solvents, which condense on the cooling coil and on the cylinder 39, can then drip down onto the collector 46. A condensate removal conduit 48 may be provided for removing collected condensate from collector 46. A second condensate collector 56, located adjacent the bottom of wall 35, is operative to collect solvents which may condense when cured drum 10 is removed at the end of a heating cycle.

A substrate receiving volume 50 is thus defined between cooling coil 40 and induction coil 36. It is a particular feature of the present invention that the top of the substrate receiving volume 50 is sealed, thus preventing air entry which would reduce condensation efficiency and increase the risk of hazardous air solvent mixture formation. The sealing also reduces solvent vapor escape.

According to a preferred embodiment, sealing means 51, typically having formed thereon a plurality of sealing rings 53, are provided below support assembly 12 to seal the bottom of receiving volume 50 once the substrate has been located within the receiving volume. Sealing of the bottom of volume 50 prevents solvent vapor escape during the heating process, allowing longer contact time of the solvent vapors with the cooling coils. Sealing the bottom also enables the present invention to operate in vacuum, in accordance with the method claimed and described in Applicant's U.S. Pat. No. 4,421,781.

Further according to a preferred embodiment, top and bottom annular members 52 and 54 are formed of the same material as barrel wall substrate 10. Members 52 and 54 are operative to afford continuous, uniform metal exposure to induction coil 36, thereby to prevent uneven temperature distribution in barrel wall portion 10. Annular means 52 and 54 are typically of substantially the same diameter as the cylinder and are typically approximately 10 cm high and spaced about 1 cm from the top and bottom, respectively, of the drum. Annular means 52 and 54 are arranged such that a substantial portion of their height, typically half, faces the induction coil such that "edge effects" of drum temperature are almost entirely eliminated.

Upon completion of curing, the support assembly 12 lowers the barrel wall substrate 10 out of operative association with the curing unit.

Figure 3:
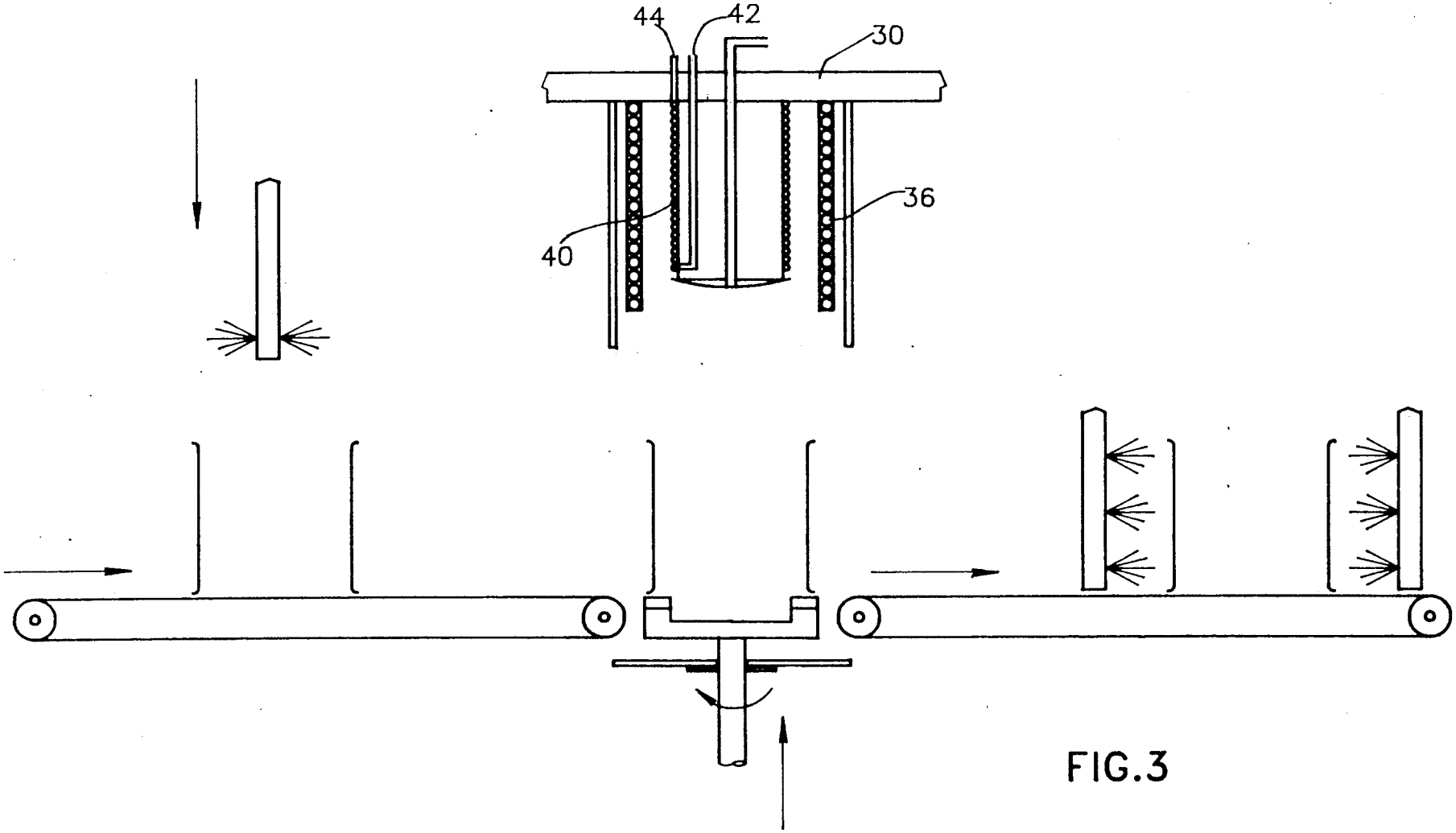
FIG. 3 is a schematic illustration of part of a coating line employing the apparatus of FIGS. 1 and 2.

Reference is now made to FIG. 3, which illustrates part of a coating line employing the apparatus. It is seen that following coating and heating or curing of the coating using the apparatus of FIGS. 1 and 2, the barrel wall portion may be cooled by atomizing a liquid, such as water, thereon. The barrel wall portion should be cooled relatively quickly to a temperature of approximately 120° C., to avoid overheating and resulting degradation of the organic coating.

It will be appreciated by persons skilled in the art that the present invention is not limited by what has been particularly shown and described hereinabove. Rather the scope of the present invention is defined only by the claims which follow:

I claim:

1. Apparatus for drying or curing a coating on a metal substrate comprising: p1 an induction coil arranged in a generally cylindrical configuration;

a cooling coil arranged in a cylindrical configuration, generally cocylindrical with and spaced from the induction coil, thereby defining a receiving volume therebetween for removably receiving a generally cylindrical coated metal substrate;

a top member sealing the top of said receiving volume; and means for selectably inserting and removing the coated metal substrate from said receiving volume.

2. Apparatus according to claim 1 and also comprising a container located interiorly of said receiving volume, generally filling the volume interior of said receiving volume.

3. Apparatus according to claim 1 and also comprising means for collecting condensed solvent arranged in operative association with said cooling coil.

4. Apparatus according to claim 2 and also comprising means for collecting condensed solvent arranged in operative association with said cooling coil.

5. Apparatus according to claim 3 and also comprising means for removing the condensed solvent from said means for collecting condensed solvent.

6. Apparatus according to claim 4 and also comprising means for removing the condensed solvent from said means for collecting condensed solvent.

7. Apparatus according to claim 1 and wherein said means for selectably inserting and removing comprises means for sealing the bottom of said receiving volume when the substrate is located in said receiving volume.

8. Apparatus according to claim 1 and wherein said means for selectably inserting and removing comprises means for rotating the substrate.

9. Apparatus according to claim 1 and wherein said top member also comprises top annular insulating means and said means for selectably inserting and removing comprises bottom annular insulating means, for insulating said receiving volume.

10. Apparatus according to claim 1 and also comprising drum-like inserts located adjacent the top and bottom of the metal substrate for absorbing temperature edge effects.

* * * * *